United States Patent [19]

Noguchi et al.

[11] Patent Number: 4,640,822

[45] Date of Patent: Feb. 3, 1987

[54] APPARATUS FOR PRODUCING BULK MESOPHASE

[75] Inventors: Kosaku Noguchi, Tokyo; Honami Tanaka, Osaka; Yukimasa Kumura, Osaka; Heima Yamazaki, Osaka; Eiji Kitajima, Osaka; Tomonori Sunada, Osaka, all of Japan

[73] Assignee: Koa Oil Company, Limited, Tokyo, Japan

[21] Appl. No.: 484,550

[22] Filed: Apr. 13, 1983

[30] Foreign Application Priority Data

Aug. 11, 1982 [JP] Japan ..... 57-139467

[51] Int. Cl.[4] ..... C10C 3/00; D01F 9/12

[52] U.S. Cl. ..... 422/111; 208/40; 208/44; 422/140; 422/230; 422/234

[58] Field of Search ..... 208/8 LE, 39, 44, 45, 208/40; 423/445, 449; 422/111, 140, 230, 234, 107, 112, 113, 256, 287, 285, 231; 417/76, 78, 84

[56] References Cited

U.S. PATENT DOCUMENTS 4,230,668 10/1980 Sheely et al. ..... 422/144 X
4,363,670 12/1982 Noguchi et al. ..... 208/45 X
4,488,957 12/1984 Noguchi et al. ..... 423/447.2

OTHER PUBLICATIONS

Perry et al, *Chemical Engineer's Handbook*, 5th ed., McGraw-Hill, 1973, pp. 6-15.

Efficient Utilization of Petroleum Residue, by Hidemasa Honda; vol. 23, No. 1, 1980.

Changes of Pleochroism and Extinction Contours in Carbonaceous Mesophase, by H. Honda and H. Kimura and Y. Sanada; vol. 9, Carbon 1971, pp. 695-697.

*Primary Examiner*—David L. Lacey
*Assistant Examiner*—W. R. Johnson
*Attorney, Agent, or Firm*—Wenderoth, Lind & Ponack

[57] ABSTRACT

Bulk mesophase can be economically produced without coking trouble from a heavy oil in an apparatus comprising: a heat-treatment vessel for heat treating the oil thereby to form pitch containing mesophase microspheres; a cyclone-type separator installed directly below the vessel and operating to cause the mesophase microspheres within the pitch introduced into the separator to coalesce thereby to separate the mesophase microspheres from the matrix pitch; and ascent and descent pipes communicatively connecting the interiors of the vessel and the separator, the ascent pipe returning matrix pitch after removal of the mesophase microspheres into the vessel together with newly supplied oil, which drives the matrix pitch by jet-pump action, the descent pipe introducing the pitch with mesophase microsphere into the top part of the separator in a horizontal tangential direction to produce a cyclone separation action therein.

3 Claims, 5 Drawing Figures

APPARATUS FOR PRODUCING BULK MESOPHASE

BACKGROUND OF THE INVENTION

This invention relates to an apparatus for continuously producing bulk mesophase (mesophase agglomerates), which is a useful carbonaceous material, from a heavy oil.

When a hydrocarbonaceous heavy oil such as a petroleum heavy oil, coal tar, or oil sand is carbonized by heat treatment at 400° to 500°, microcrystals called mesophase microspheres are formed in the heat-treated pitch obtained at an early stage of the process. These mesophase microspheres are liquid crystals having a characteristic molecular arrangement. These mesophase microspheres are carbonaceous precursors which can be converted into highly crystalline carbonized products by subjecting them to further heat treatment. At the same time, since these mesophase microspheres themselves have high chemical and physical activities, great expectations are being held for their utilization for a wide scope of applications having high added values such as that as starting materials for high-quality carbon materials and starting materials for carbon fibers, binders, adsorbents, etc., after being isolated from the above mentioned heat-treated pitch. Isolated mesophase microspheres are generally called mesocarbon microbeads.

For isolation of such mesophase microspheres, a method in which only the pitch matrix containing these microspheres dispersed therein is selectively dissolved in quinoline, pyridine, or an aromatic oil such as anthracene oil, solvent naptha, or the like, and the mesophase microspheres as an insoluble component are isolated by solid-liquid separation has heretofore been proposed. However, in order to carry forward the heat treatment while avoiding formation of coke, the content of the mesophase microspheres in the heat-treated pitch (as determined quantitatively as quinoline-insoluble component according to Japanese Industrial Standards designation JIS K 2425,) can be elevated to only about 15 percent by weight at the most.

Furthermore, a quantity of the solvent for separation of the mesophase microspheres which is 30 times or more by weight that of the heat-treated pitch becomes necessary. Accordingly, in the method for isolating the mesophase microspheres by selective dissolution of the matrix pitch as described above (hereinafter sometimes referred to as "solvent separation method"), it is necessary to use a solvent in a quantity which is 200 times or more by weight that of the mesophase microspheres to be obtained, whereby it has been considered inevitable that the productivity will be very low.

With respect to these problems, it occurred to us that the mesophase as a molding material might not necessarily be in the form of microspheres. Accordingly, we have previously developed a method in which, by imparting a turbulent-flow state to pitch containing mesophase microspheres, the mesophase microspheres are caused to coalesce and to undergo sedimentation separation as agglomerated mesophase. This method has been proposed this disclosed in U.S. patent application Ser. No. 382,360, filed 05/26/82, now U.S. Pat. No. 4,488,957, issued Dec. 19, 1984, in which priority was claimed, based upon Japanese Pat. Application No. 83965/1981, filed 06/01/81.

SUMMARY OF THE INVENTION

It is an object of this invention to provide an apparatus for carrying out stable and continuous operation over a long period in producing bulk mesophase by applying the principle of the above mentioned promotion of separation of mesophase microspheres from the matrix pitch due to coalescing and agglomeration.

More specifically, the apparatus for producing bulk mesophase of this invention comprises a heat-treatment vessel for heat treating a starting-material heavy oil thereby to form pitch containing mesophase microspheres; a separation vessel of the shape of an inverted cone disposed below the heat-treatment vessel and operating to cause the mesophase microspheres within the pitch introduced into the separation vessel from the heat-treatment vessel to coalesce thereby to separate the mesophase microspheres from the matrix pitch; a descent pipe for introducing the pitch containing the mesophase microspheres from the heat-treatment vessel into the separation vessel; an ascent pipe for introducing the matrix pitch from which the mesophase microspheres have been thus removed in the separation vessel into the heat-treatment vessel; and a starting-material supply pipeline connected at its upstream end to a source of starting-material heavy oil including a starting-material supply pump and inserted at its downstream end into the ascent pipe, the lower end part of the descent pipe being connected to the upper side wall of the separating vessel in a tangential direction thereto, the ascent pipe being inserted at its lower end part coaxially into the central part of the separation vessel and having at an intermediate part thereof an inner wall surface with an intermediate throat part of constricted inner diameter, the extreme downstream tip of the starting-material supply pipeline being positioned coaxially within and in the vicinity of said throat part.

The nature, utility, and further features of this invention will become more clearly apparent from the following detailed description, including a specific example of structural organization and operation of the apparatus according to the invention, when read in conjunction with the accompanying illustrations, briefly described below.

ILLUSTRATIONS

In the illustrations:

DETAILED DESCRIPTION OF THE INVENTION

Figure 1:
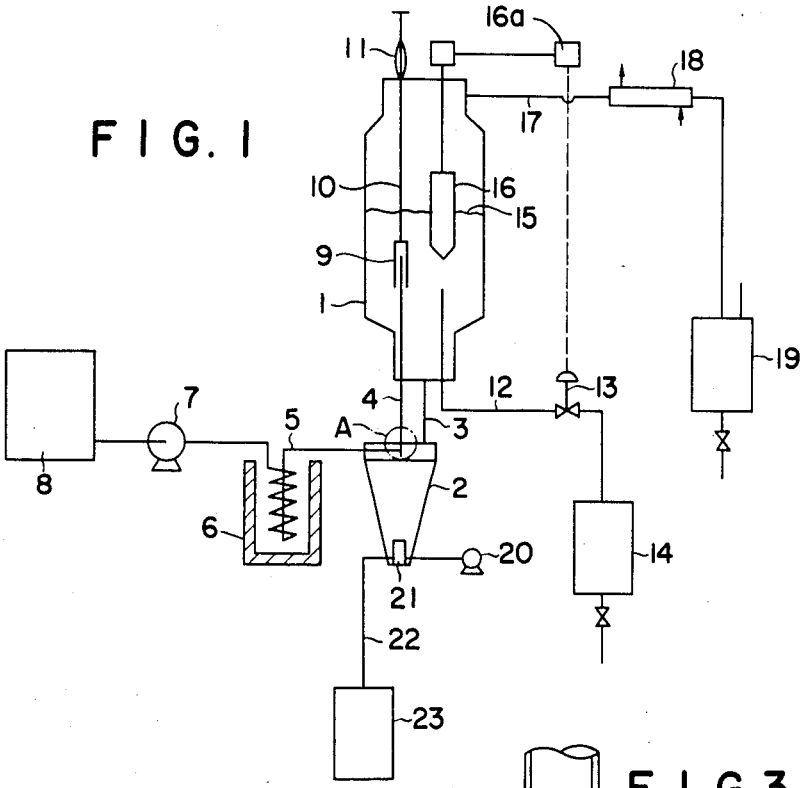
FIG. 1 is a schematic diagram, in the form of a flow chart, showing an example of arrangement of essential parts of the apparatus for producing bulk mesophase according to this invention.

Referring first to FIG. 1, the example of the apparatus of this invention shown therein has, as its basically essential parts, a heat-treatment vessel 1 substantially of the shape of an elongated vertical cylinder, a separation vessel or separator 2 having the shape of an inverted cone (cyclone shape) and disposed substantially immediately below the heat-treatment vessel 1, and a descent pipe 3 and an ascent pipe 4 communicatively joining the interiors of the vessel 1 and the separator 2 as described hereinbelow.

Figure 2:
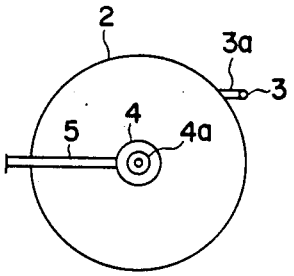
FIG. 2 is a plan view of the separation vessel in the apparatus.
Figure 3:
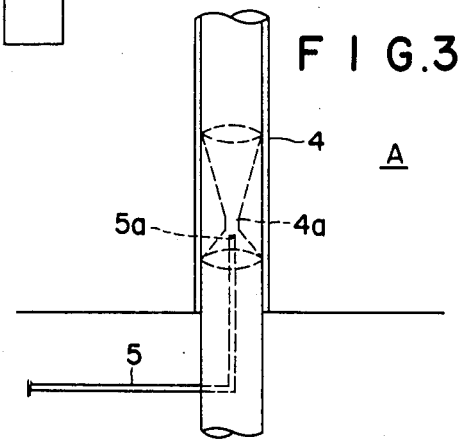
FIG. 3 is an enlarged elevation of the portion designated by A in FIG. 1.

The state of connection of the descent and ascent pipes 3 and 4 to the separator 2 is as indicated in FIG. 2, which is a plan view of the separator. The descent pipe 3 at its lower end is bent into a substantially horizontal lower-end portion 3*a*, which at its end is directed tangentially to and connected to the upper side wall of the separator 2. The lower end portion of the ascent pipe 4 is inserted into the upper central part of the separator 2. As shown in FIG. 3, which is an enlarged view of the portion A in FIG. 1, the ascent pipe 4 is provided at an intermediate part thereof with a conduit located internally thereof, wherein the conduit has a throat portion 4*a* of constricted inner diameter and wherein the conduit has an inner surface in the shape resembling a venturi tube or jet pump. In the vicinity of and coaxial within this throat 4*a* is disposed the discharge tip 5*a* at the downstream end of a pipeline 5 for supplying starting-material oil. The upstream end of this oil supply pipeline 5 is connected by way of a pump 7 to a starting-material oil tank 8.

Within the heat-treatment vessel 1, the upper end of the ascent pipe 4, which is disposed below the surface 15 of the liquid in the vessel 1, is accommodated within a vertical tubular structure 9 having an open lower end and a closed upper end. The upper end of this tubular structure 9 is fixed to the lower end of a rod 10 extending downward from the top of the heat-treatment vessel 1 and is adapted to be raised and lowered by a mechanism 11 mounted atop the vessel 1. By thus raising and lowering of the tubular structure 9, the opening area at the upper end part of the ascent pipe 4 can be adjusted thereby to control the flow rate of liquid through the ascent pipe 4.

At the bottom of the heat-treatment vessel 1, there is provided a pitch draw-out pipeline 12 which is connected via a control valve 13 to a pitch tank 14 outside the heat-treatment vessel. The control valve 13 is controlled by control means 16*a* operating in response to the output of a liquid level gage 16 of the displacement type installed within the heat-treatment vessel 1 to detect the level of the liquid surface 15 therewithin. One end of a pipeline 17 for drawing out cracked light oil is connected to the upper part of the heat-treatment vessel 1 to communicate with the upper space therewithin. The other end of the pipeline 17 is connected by way of a condenser 18 to a light oil tank 19.

At the bottom part of the aforedescribed separator 2, there is provided a pump 21 adapted for transferring viscous liquid such as a gear pump driven by a motor 20. The delivery port of this pump 21 is connected by a pipeline 22 to a mesophase collecting tank 23.

The apparatus of the above described organization according to this invention is operated in the following manner to carry out continuous production of bulk mesophase. Quantities expressed in percent (%) are by weight unless specified otherwise.

The starting-material heavy oil is placed in the starting-material oil tank 8. Examples of this heavy oil are petroleum heavy oils such as normal-pressure distillation residue, reduced-pressure distillation residue, decant oils obtained by catalytic cracking, and thermally cracked tars and heavy oils obtained from coal such as coal tar. This heavy oil in the supply tank 8 is fed by the pump 7 through the heater 6, where it is heated to the reaction temperature or a somewhat higher temperature. The oil thus heated then flows through the pipeline 5 and, together with matrix pitch from the separator 2, ascends through the ascent pipe 4 to enter the heat-treatment vessel 1. As mentioned hereinbefore, by raising and lowering the rod 10 and the tubular structure 9 by means of the mechanism 11, the opening area at the upper end part of the ascent pipe 4 can be adjusted, that is, the resistance to fluid flow between the tubular structure 9 and the upper end part of the ascent pipe 4 can be adjustably varied. Thus the fluid supply flow rate through the ascent pipe is controlled.

The temperature of the contents of the heat-treatment vessel 1 (i.e., the reaction temperature) is maintained at 400° to 500° C., preferably 400° to 460° C. With a retention or residence time of 30 minutes to 5 hours, as determined by the formula (volume of the heavy oil in the heat-treatment vessel 1 / volumetric flow rate of starting material passing through supply pipeline 5) at this temperature, polycondensation reaction of the starting material heavy oil is carried out thereby to form matrix pitch containing mesophase microspheres within limits such that coke-like bulk mesophase or coke-like carbonized product is not formed as a consequence of excessive reaction.

By this heat treatment, in general, heat-treated pitch containing mesophase microspheres of a quantity of the order of 2 to 15 percent as measured as the quinoline-insoluble matter is obtained. The level of the liquid surface 15 in the heat-treatment vessel 1 is controlled by the adjustment of the degree of opening of the control valve 13 by the control means 16*a* in response to the output of the liquid level gage 16 thereby to adjust the flow rate of the pitch drawn out of the vessel 1 and sent to the pitch tank 14. The retention time in the heat-treatment vessel 1 is adjusted by the control of this liquid surface level and the control of the supply flow rate of the starting materials.

A considerable portion of the starting-material heavy oil supplied into the heat-treatment vessel 1 is changed by thermal cracking into light oils, which are drawn out in the form of vapor through the pipeline 17, condensed in the condenser 18, and then stored in the light oil tank 19. These light oils, of course, are further subjected to fractional distillation as necessary.

On the other hand, the greater part of the heat-treated pitch containing the mesophase microspheres formed in the heat-treatment vessel 1 flows downward under the force of gravity through the descent pipe 3 and is injected into the upper part of the separator 2 in the tangential direction relative to the side wall thereof, thus becoming a revolving flow and descending gradually in the separator. The mesophase microspheres at this time mutually coalesce because of the resulting turbulence effect and, as they become agglomerated, are separated by centrifugal force from the matrix pitch to settle on the bottom of the separator 2.

The viscosity of the heat-treated pitch passing through the descent pipe 3 is of the order of 100 cst at 200° C. When the viscosity of this pitch at the reaction temperature is estimated by extrapolation of the viscosity—temperature curve of the pitch, it is found to be approximately 1 cst, which is substantially the order of the viscosity of water of room temperature. This means that the fluidity of the pitch necessary for its flowing downward under the force of gravity and for its forming a revolving flow within the separator 2 is amply maintained.

On the other hand, for good coalescing and agglomerating effect due to turbulence, a low temperature within the separator 2 is desirable, being preferably 5° C. or more, particularly, 10° C. or more, lower than the reaction temperature. However, if this temperature within the separator 2 is lowered excessively, the fluidity of the heat-treated pitch will be lowered, and therefore it is desirable that this temperature be maintained at 250° C. or higher. The mesophase agglomerates or bulk mesophase which has settled on the bottom of the separator 2 is drawn out of the separator 2 by the pump 21 and sent through the pipeline 22 and into the mesophase collecting tank 23 to be stored therein.

Figure 4:
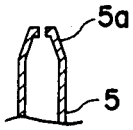
FIG. 4 is an enlarged elevation showing the tip of a starting-material oil supply pipe.

The matrix pitch remaining in the separator 2, still containing a considerable amount of mesophase microspheres, forms an ascending flow through the center of the separator 2 to the upper part of the separator, where the lower end part of the ascent pipe 4 is inserted into the separator. The ascending matrix pitch is thus drawn upward through the ascent pipe 4 into the heat-treatment vessel 1. The force by which this matrix pitch is drawn upward is imparted by the viscous entrainment or induction action of the starting-material heavy oil injected from the discharge tip 5*a* of the heavy oil supply pipeline into and through the constricted throat part 4*a* of the ascent pipe 4. The mechanism of this action is similar to that of an aspirator or a jet pump. In order to obtain a great injection energy at the discharge tip 5*a* to impart a great drawing force on the matrix pitch, the discharge tip 5*a* is preferably constricted into the form of a nozzle as illustrated by one example in FIG. 4.

The bulk mesophase stored in the mesophase collecting tank 23 is used directly as it is, or after being subjected to an after treatment as a carbonaceous starting material or for some other purpose. In one after treatment, the bulk mesophase is reheated at a temperature of the order of 350° C. thereby to cause the quinoline-soluble component to be exude out so as to reduce this component. Examples of other after-treatment procedures are centrifugal separation and washing as by solvent naphtha.

On the other hand, the pitch containing mesophase microspheres collected in the pitch tank 14 may be used as binder pitch, for example, or it may be recycled to the heat-treatment vessel 1 to be further thermally cracked and caused to undergo polycondensation.

As will be apparent from the foregoing description, a feature of the apparatus for producing bulk mesophase of this invention is that the number of mechanical driving mechanisms such as pumps which act directly on and drive viscous fluids at high temperatures is small. However, if necessary, it is also possible to insert a flowmeter in the descent pipe 3 to measure the circulation flow rate of the pitch. For this purpose, a flowmeter in which the flow rate measuring section and the indicating section are mechanically separate, for example as disclosed in the specification of Japanese Utility Model Application No. 182213/1981, which we have previously developed, is highly suitable.

More specifically, this proposed flow meter comprises a swinging resistance plate swingably supported within the flow path of the fluid flowing in a pipe, a magnet mounted on the resistance plate a magnetic needle swingably supported outside of the pipe and adapted to be acted upon by the magnetic force of the magnet, and means for reading the swing of this magnetic needle which follows the swing of the swinging resistance plate in accordance with the flow rate of the fluid.

In order to indicate more fully the nature and utility of this invention, the following actual example of the apparatus of this invention and an example of operation thereof to produce bulk mesophase is presented with specific details, it being understood that these examples are presented as illustrative only and are not intended to limit the scope of the invention.

EXAMPLE

Production of bulk mesophase from a decant oil obtained by catalytic cracking was carried out by using an apparatus which was substantially as shown in FIG. 1.

The inner diameter of the heat treatment vessel 1 was approximately 300 mm. The separator 2 had the shape of an inverted cone of a height of 500 mm, a bottom inner diameter of 100 mm, and an upper part inner diameter of 250 mm and was provided additionally in its upper part with a vertical cylinder of 200 mm height. The descent pipe 3 had an inner diameter of 41.2 mm and a length of 1.2 meters (m). The ascent pipe 4 had an inner diameter of 41.2 mm, and a throat part of an inner diameter of 10 mm at an intermediate part thereof. The inner diameter of the starting-material supply pipe 5 was 4 mm, and the nozzle diameter at its injection tip 5*a* was 1 mm.

The starting material oil was supplied by the pump 7 from the tank 8, through the pipeline 5 and the ascent pipe 4, and into the heat-treatment vessel 1 at a flow rate of 300 g/sec. The temperature within the heat-treatment vessel 1 was maintained at 430° C. With an average retention time of approximately 3 hours in this vessel 1, a pitch containing mesophase microspheres as a quinoline-insoluble component of 3.7 percent was formed in this vessel 1. This pitch (of a viscosity of 130 cst at 200° C.) was fed into the separator 2 through the descent pipe 3 as its flow rate was controlled at 15 l/min. by raising and lowering the rod 10.

The difference between the levels of the liquid surfaces in the heat-treatment vessel 1 and the separator 2 was approximately 2.3 m. The flow velocity of the pitch in the descent pipe 3 became 18.8 cm/sec., which became the approximate tangential flow velocity imparted in the separator 2. While, in the apparatus of this example, the flow rate through the descent pipe 3 could be increased to approximately 30 l/min (or a pitch flow velocity of 37 cm/sec.), it was controlled to 15 l/min, which was found to be suitable for obtaining good separation action.

The inner temperature of the separator 2 was set at approximately 420° C. From the bottom of the separator 2, bulk mesophase was obtained at a flow rate of 20 g/min.

From the lower end of the ascent pipe 4, matrix pitch (still containing 3.1 percent of a quinoline-insoluble component) was drawn upward by the jet-pump action of the starting-material oil injected from the nozzle tip 5*a* of the oil supply pipe 5 and flowed at a rate of approximately 15 l/min through the ascent pipe 4, thus being circulated into the heat-treatment vessel 1. The flow velocity of the starting-material oil injected out of the nozzle tip 5*a* was 1,060 cm/sec.

Through the pipeline 17, cracked light oil, including a gas component, was drawn out at a flow rate of 175 g/min, while, through the pipeline 12, pitch containing mesophase microspheres was drawn out at a flow rate of 105 g/min.

Figure 5:
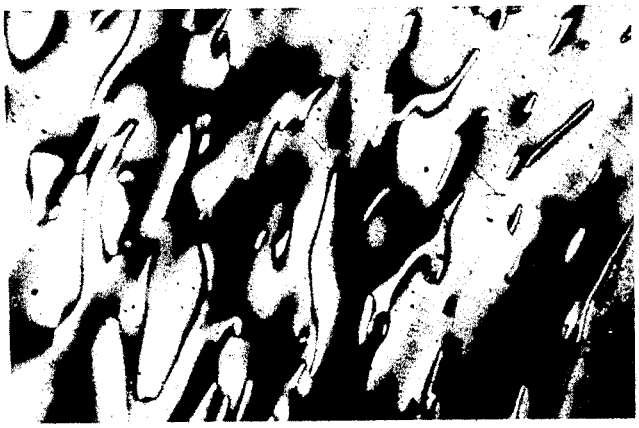
FIG. 5 is a photomicrograph (magnification, X 170), taken through a polarizing microscope, of bulk mesophase produced by means of the apparatus of the invention.

The bulk mesophase drawn out from the bottom of the separator 2 had a content of a quinoline-insoluble component of 70.6 percent, a volatile component content of 34.2 percent, and a C/H atomic ratio of 1.70. As photographed through a polarizing microscope at a magnification of 170 times, this bulk mesophase appeared as in FIG. 5, which indicated that its entire surface comprised an optically anisotropic substance.

From the results of the above described example of practice, it can be concluded that, although this experimental operation was carried out with a small-scale apparatus, the possibility of continuous production on an industrial scale with the apparatus according to this invention for producing bulk mesophase has been fully demonstrated.

The possibility of continuous production in a stable and reliable manner of bulk mesophase by means of the apparatus of this invention may be attributed to its nature, the principal features of which are as follows.

(a) The separator is installed directly below the heat-treatment vessel, whereby coking trouble, which tends to become a problem at the bottom of the heat-treatment vessel and in the piping, can be prevented.

(b) By the adoption of a jet pump for circulating the pitch, trouble which tends to arise in the transfer of high-temperature, high viscosity fluids of this kind can be prevented.

(c) By the adoption of a mechanism which adjustably varies the area of the opening at the upper end of the ascent pipe instead of an ordinary piping valve in the control of the flow rate of the pitch circulation, trouble such as valve clogging can be prevented.

(d) Because of the use of a cyclone-type separator for coalescing and agglomerating of the mesophase microspheres, the use, here also, of a mechanical device such an agitator can be avoided.

(e) As a whole, the use of mechanical devices for transferring viscous fluids is avoided as much as possible, trouble which are apt to arise in the transfer of high-temperature, viscous fluids can be prevented.

What is claimed is:

1. An apparatus for producing bulk mesophase comprising; a heat-treatment vessel for heat treating a starting material heavy oil to form pitch containing mesophase microspheres, a separation vessel for agglomerating the mesophase microspheres in the pitch introduced into the separation vessel to thereafter separate the agglomerated mesophase microspheres, and a tank containing a starting material heavy oil operatively connected to said heat-treatment vessel through a starting-material supply pipeline, said separation vessel being positioned below said heat-treatment vessel and having an upper side wall and further being in the shape of an inverted cone wherein said heat-treatment vessel is connected to said separation vessel by a descent pipe and an ascent pipe which are in parallel relationship with each other, said descent pipe having a lower end connected to the upper side wall of the separation vessel and in tangential relation thereto, said ascent pipe having an upper end and a lower end, with the lower end extending coaxially into a central portion of the separation vessel and having a conduit located internally thereof, said conduit having a throat portion of constricted inner diameter, said starting-material supply pipeline having a discharge tip extending coaxially into said ascent pipe, the discharge tip of the starting-material supply pipeline being positioned coaxially in the vicinity of said throat portion so as to draw the matrix pitch into said heat-treatment vessel from said separation vessel by a drawing force of an injection energy created at the throat portion by the starting-material heavy oil injected from the discharge tip of the starting-material supply pipeline, said heat-treatment vessel having a means for controlling the flow rate of supply of the strating material heavy oil and the matrix pitch into the heat-treatment vessel, said means comprising a vertical tubular structure having an open lower end and a closed upper end and accommodating the upper end of said ascent pipe with a specific radial clearance therebetween, and a mechanism connected to the tubular structure and positioned and arranged so as to be operable from outside of the heat-treatment vessel to raise and lower the tubular structure so as to adjustably vary the area of opening of the upper end of said ascent pipe.

2. An apparatus according to claim 1, further comprising a pump means for drawing out agglomerated mesophase from a bottom portion of the separation vessel.

3. An apparatus according to claim 1, further comprising a preheater surrounding a portion of the starting material supply pipeline.

* * * * *